US005328047A

United States Patent [19]

Smith

[11] Patent Number: 5,328,047

[45] Date of Patent: Jul. 12, 1994

[54] DOUBLE LOCKING PAIL AND COVER FOR REGULATED MATERIALS

[75] Inventor: Arthur H. Smith, East Brunswick, N.J.

[73] Assignee: North America Packaging Corporation, Bala Cynwyd, Pa.

[21] Appl. No.: 969,399

[22] Filed: Oct. 30, 1992

Related U.S. Application Data

[63] Continuation of Ser. No. 817,064, Jan. 6, 1992, abandoned.

[51] Int. Cl.[5] ..... B65D 41/16

[52] U.S. Cl. ..... 220/307; 220/306; 220/308

[58] Field of Search ..... 220/307, 308, 355

[56] References Cited

U.S. PATENT DOCUMENTS

| | | | |
|---|---|---|---|
| 3,458,079 | 7/1969 | Gasbarra | 220/307 |
| 3,817,420 | 6/1974 | Heisler | 220/307 |
| 4,210,258 | 7/1980 | Von Holdt | 220/306 |
| 4,293,080 | 10/1981 | Letica | 220/306 |
| 4,308,970 | 1/1982 | Von Holdt | 220/306 |
| 4,453,646 | 6/1984 | Harrild | 220/258 |
| 4,518,097 | 5/1985 | Milton et al. | 220/307 |
| 4,640,435 | 2/1987 | Dutt | 220/307 |
| 4,708,259 | 11/1987 | Olimpio | 220/306 |
| 4,787,530 | 11/1988 | Edwards | 220/266 |
| 4,836,407 | 6/1989 | Bruce et al. | 220/276 |

*Primary Examiner*—Allan N. Shoap
*Assistant Examiner*—Vanessa Caretto
*Attorney, Agent, or Firm*—Stuart S. Bowie

[57] ABSTRACT

A container and cover therefor, preferably of plastic, and particularly designed for Regulated Materials, having two sets of locking means for securing the container and cover.

4 Claims, 4 Drawing Sheets

DOUBLE LOCKING PAIL AND COVER FOR REGULATED MATERIALS

This is a continuation of my Application filed Jan. 6, 1992, Ser. No. 07/817,084, now abandoned in favor of this application.

BACKGROUND OF THE INVENTION

1. Field of the Invention

Plastic pails and containers especially of relatively large size, e.g., 3.5 gallons or more, and locking covers therefore. (hereinafter, for the sake of simplicity, "pail(s) and container(s)" are referred to as "container(s)".)

2. Background Art

Plastic containers with single locking covers, generally of the 3.5 gallon or more size and especially intended to contain (but not limited to) "Regulated Materials" as defined by the United States Department of Transportation ("DOT"). Such Regulated Materials Include, but are not limited to toxic, corrosive, flammable and poisonous materials, and may be liquid and non-liquid (e.g., granular).

SUMMARY

The invention relates to containers and locking covers therefor, especially those made of plastic, and especially to containers for those materials described above and referred to collectively as "Regulated Materials".

Typically such containers and locking covers therefor are made of PE, HDPE, or PP, but other plastic materials may be used.

Such containers and locking covers therefor are molded, usually by injection molding apparatus. Such apparatus is well-known in the art.

Containers and covers therefore for Regulated Materials must adhere to very strict governmental regulator requirements both for domestic and international use. For example, the Federal Department of Transportation (DOT) has issued regulators (HM-181) which set minimum performance level requirements based on the hazardous (Regulated) material(s) to be packaged. DOT has also set minimum requirements which are defined in the U.S. Code of Federal Regulations (CFR Title 49). Such regulations require minimum limits relating to drop-test results, burst-strength and so on. The regulations are intended to ensure that, during shipment, if the containers and covers therefore are dropped, or bounced (such as a truck going over a high bump) or otherwise subjected to stress or impact, they will not burst and spill out the Regulated Materials. This also applies to the same type of rough handling or dropping which can occur at the plant where the containers are filled with the Regulated Materials and at the plant or other facility where they are shipped.

As can thus be appreciated, it is of utmost importance that containers filled with Regulated Materials to which covers are applied be constructed not only to adhere with the aforesaid governmental regulation, but also to provide the maximum possible protection against the covers becoming dislodged during shipment or other handline, in order to protect human safety and the environment.

Stated briefly, the object of this invention is to provide containers and locking covers therefor for Regulated Materials (and for other uses also) which have the structural integrity, impact resistance and burst strength, etc. which meet or exceed governmental regulations and which, by having extraordinary integrity against breaking open, enhance the prevention of accidental spillage of poisonous, toxic or other dangerous materials into the environment.

The object is accomplished by providing a plastic container with a unique double-locking cover, as will be described below.

DESCRIPTION OF THE PREFERRED EMBODIMENT

Figure 1:
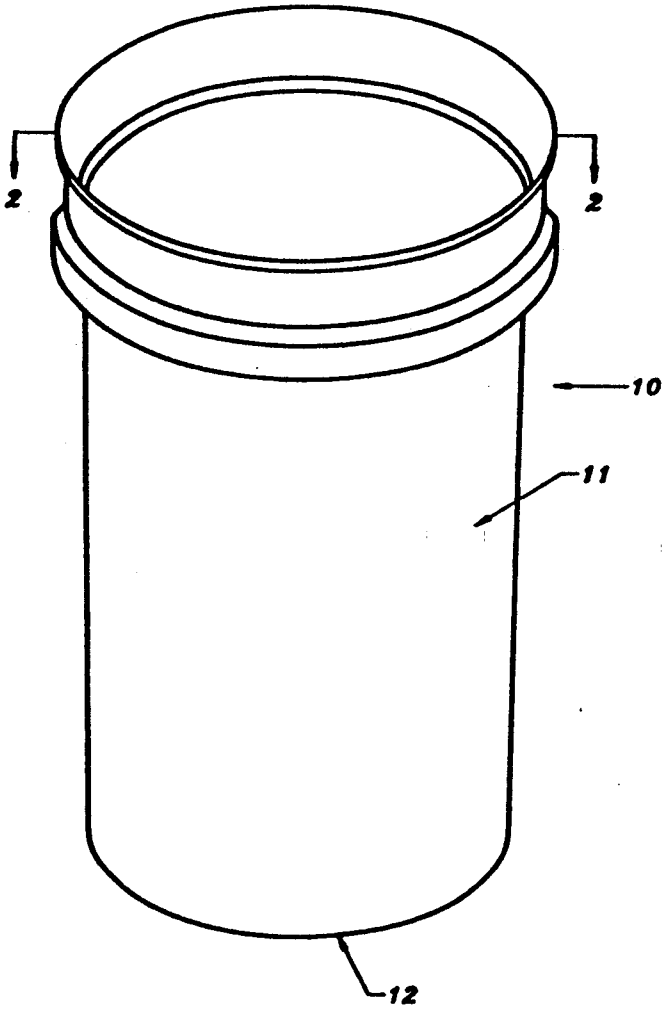
FIG. 1 is a view in elevation of a container representing one preferred embodiment of the container of this invention.

In FIG. 1 there is shown a container 10 having a vertical wall 11 and bottom 12.

Figure 1A:
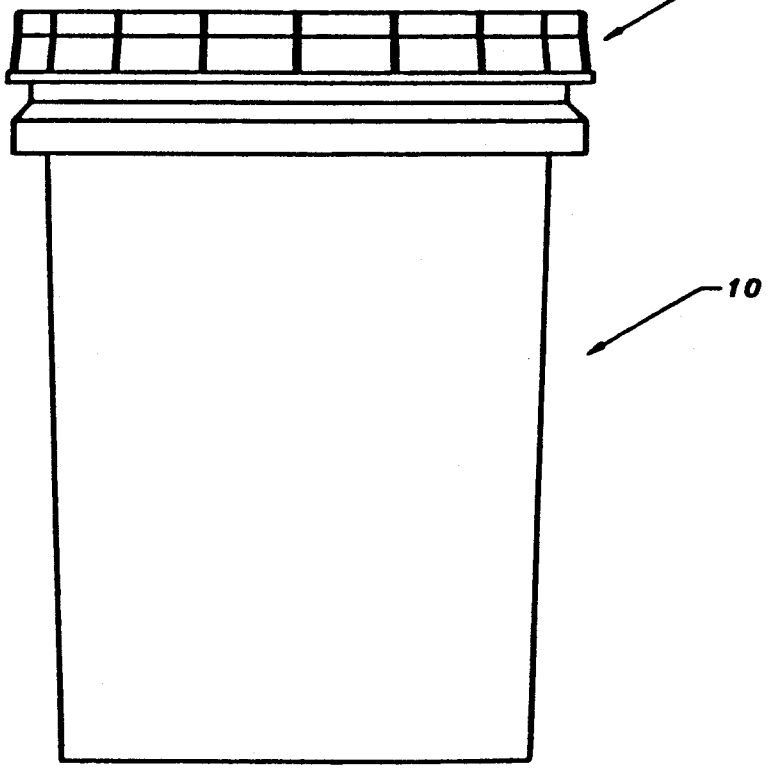
FIG. 1A is a view in elevation of the container shown in FIG. 1 connected to a double locking cover representing one preferred embodiment of the cover of this the invention.

FIG. 1A further shows a double locking cover 20 of this invention attached to the container 10.

Figure 2:
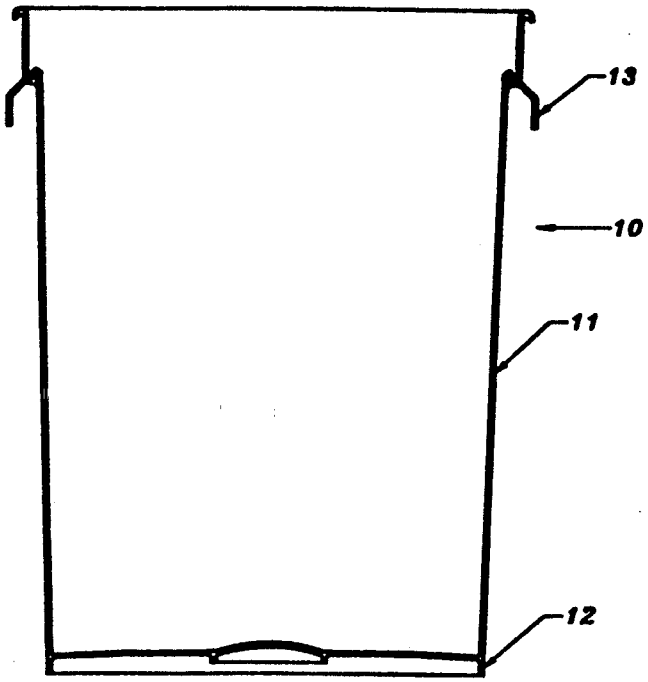
FIG. 2 is a view in vertical section of the container of FIG. 1 taken along the lines 2—2 of FIG. 1.

FIG. 2 is a view in vertical section of the container 10 taken along the lines 2—2 of FIG. 1.

Figure 3:
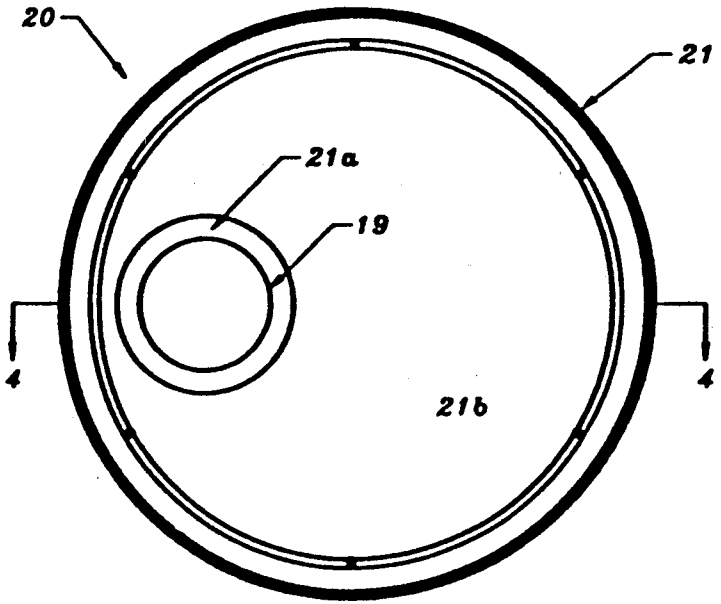
FIG. 3 is a top plan view of the locking cover shown in FIG. 1A.
Figure 4:
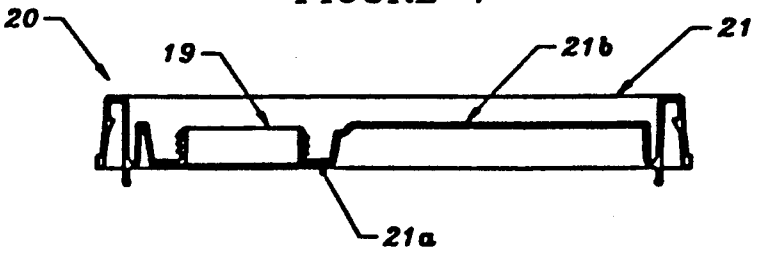
FIG. 4 is a sectional view along the liens 4—4 of FIG. 3 showing the double locking cover.

FIG. 3 is a top plan view of the double locking cover 20 shown in FIG. 1A.

Container 10 and cover 20 may preferably be made by injection molding of one or more of Polyethylene (PE), High Density PE(HDPE), Low Density PE (LDPE), Polypropolyene (PP) or other plastics suitable for use as containers and locking covers therefore, or combinations of these plastics.

The container 10 and attached double locking cover 20 are designed for Regulated Materials, but will have utility in many applications. For Regulated Materials, as explained above, they must comply with governmental regulations to ensure they do not burst if dropped, bounced or jarred during shipping, etc.

Figure 5:
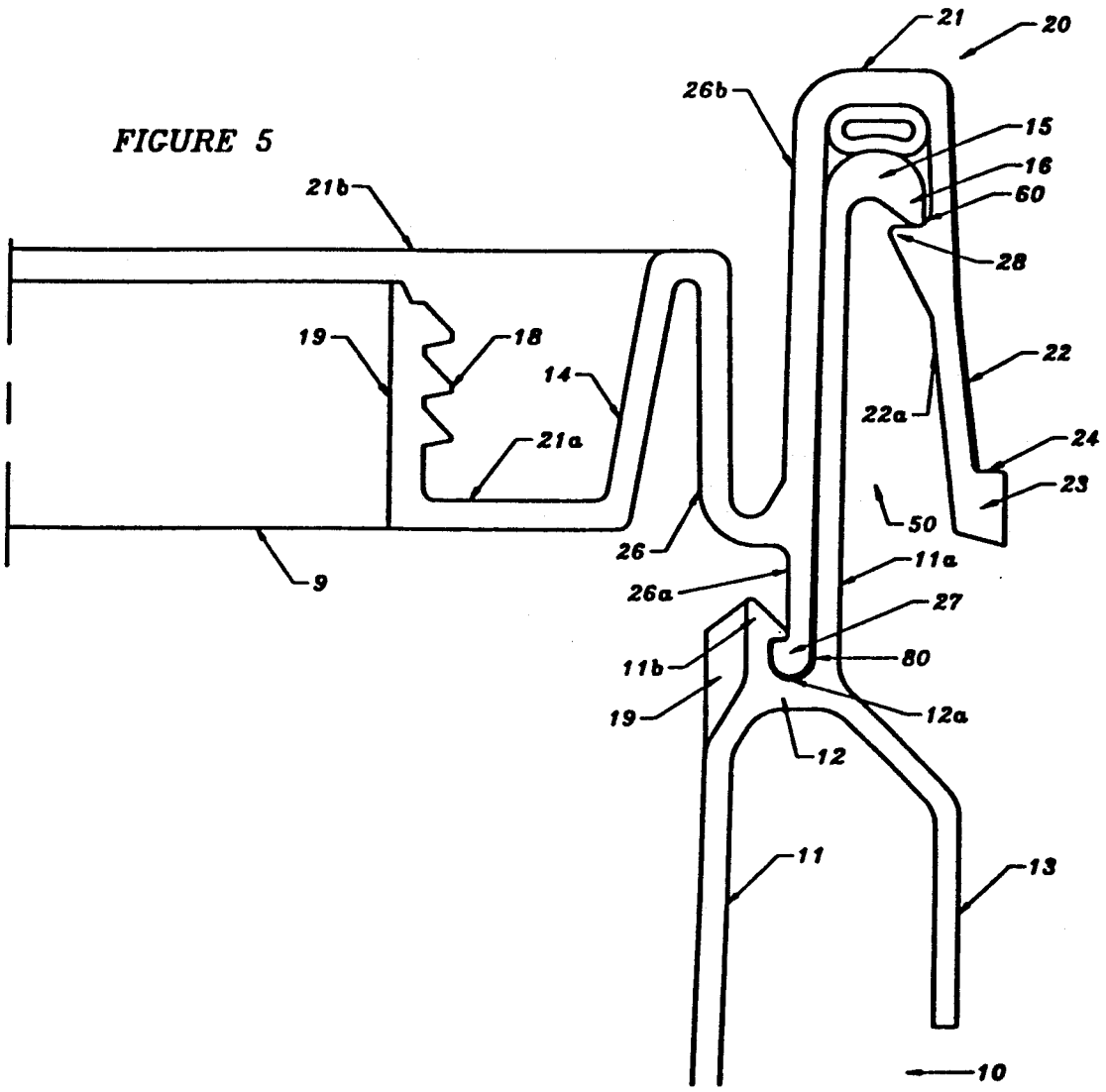
FIG. 5 is an enlarged fragmentary view showing details of the double locking cover and container shown in FIGS. 1A, 3 and 4.

The cover 20 has a top 21 which includes a top edge **21*b* as shown in FIG. 5, cover 20 has a spout 19 threaded at 18** for a spout cover (nots shown).

Cover 20 has a peripheral structure including an integral downwardly depending outer skirt 22 and an inner cover all **26*a* which terminates, at its lower end, in a second locking member 27** which, in cross-section, is quasi J-shaped.

Cover 20 has, as indicated, a downwardly depending outer integral skirt or wall 22. Skirt 22 terminates at its lower end in a flange 23 which extends outwardly, thus forming shoulder 24.

As shown in FIG. 5, cover 20 includes a first inner side wall 14, spaced from outer cover wall 26.

As can be observed in FIG. 5, a space 50 exists between the inside wall **22*a* of outer skirt 22 and the facing surface of upwardly extending container member 11*a***.

It will be observed that skirt 22 is constructed with an inwardly projecting female locking element 28 which functions, in a cooperative fashion, to form a first cover lock assembly, generally designated as 60.

The first cover lock assembly 60 also includes an enlarged upper end 15 of container wall portion 11*a*. (Member 15 and the structure at 12 in FIG. 5 are sometimes referred to as the "top portion" of container 10.) Member 15, which forms the top ring of container 10, terminates in as downwardly extending male locking member 16, called a "container curl", which is held in locking engagement with first cover lock member 28. It will be understood that the male locking member 16, which is an extension of container 10, is locked to cover 20 by female locking member 28. Thus, members 15 and 28 together form a first lock assembly.

To explain how the second cover lock assembly functions, attention is directed to FIG. 5 wherein container 10 has a vertical wall 11 terminating in an upper container shoulder 12. Formed integral with shoulder 12 is an outwardly extending reinforcing rib 19.

Also formed integral with wall 11 is a second lock member 11*b*, which, together with a depression 12*a* formed in the upper surface of shoulder 12 of wall section 11, forms a quasi J-shaped female locking ring 80.

Cover leg 26*b* has a lower portion 26*a* which extends below the lower surface 9 of cover 20. Its lower portion terminates in a quasi J-shaped male locking member 27. Locking member 27 is only slightly smaller in dimension than female locking ring 80.

Thus, as shown in FIG. 5, male cover lock member 27 is forced into female locking ring 80 and the combination forms a second cover locking assembly which securely holds (or locks) member 27 in place and thereby secures cover 20 to the container 10 in cooperation with the first locking assembly 60.

Thus, it will be observed that this invention provides a unique cover and container which have a double-locking system and means for securely attaching the cover 20 to the container 10.

Cover 20 may be removed only be exerting strong manual or tool pressure against skirt 22 sufficient to move member 28. As this is being done, lock element 27 is pulled from its force (friction) fit within locking ring 80 past locking tip 11*b* and the cover 20 may then be removed.

It will be appreciated that the provision of two locks attaching cover 20 to container 10 greatly strengthens the over all attachment between the cover 20 and container 10 which is so vital for Regulated Materials and which is an important improvement for other materials also.

There may be, in some circumstances, advantage in placing grooves on the inside and/or outside of the side and/or bottom walls of container 10 or on the upper and/or lower surfaces of cover 20 in order to obtain greater strength and/or reduction in materials use. Other means of achieving such results include spaced, depressed areas, such as essentially half-circular "dimples".

I claim:

1. A receptacle assembly comprising an open top container and a cover (20) threfore, said cover having top (21*b*) and lower edges (9) and a periphery thereabout, said assembly comprising:

a. a container having a bottom; and a side wall integrally connected to the bottom and extending upwardly from said bottom and terminating in a container wall top portion;

b. said cover periphery having a first inner peripheral wall (26) extending downwardly from said top edge (21*b*) for a selected distance and then extending radially outwardly and upwardly away from said first cover wall (26) for a selected distance to form a second integrally connected wall;

c. said second cover wall having an upper portion (26*b*) and a lower portion (26*a*);

d. said upper portion (26*b*) of said second cover wall extending radially away from the first cover wall (26) to form a top segment (21);

e. a third cover wall integrally connected with, and extending downwardly from the top segment (21), said third cover wall including locking means (28) extending radially toward said second cover wall (26*b*);

f. said container wall top portion (11) having an upper extension (11*a*) terminating in a locking means (16) for locking engagement with said cover locking means (28), whereby said locking engagement of said container locking means (16) and said cover locking means (28) forms a first locking assembly;

g. said container top wall portion having a tower portion with a shoulder (12) and an upwardly opening depression (12*a*) formed in the shoulder;

h. said shoulder also including an upwardly extending lock member radially inwardly of said upper extension comprising a radially outwardly extending element having a portion (11*b*) extending over part of said depression to form a locking channel ring (80);

i. said second cover wall lower portion (26*a* ) terminating in a substantially J-shaped locking tip (27) which fits into locking engagement with said ring (80) to form a second locking assembly.

2. The invention of claim 1 wherein the first and second locking assemblies extend substantially continuously around the cover periphery.

3. The invention of claim 2 wherein there is a space below said top segment (21) and above said locking means adjacent thereto (16) and wherein a sealing gasket is positioned within said space.

4. The invention of claim 1 wherein there is a space below said top segment (21) and above said locking means adjacent thereto (16) and wherein a sealing gasket is positioned with said space.

* * * * *